US005529002A

United States Patent [19]

Piller

[11] Patent Number: 5,529,002

[45] Date of Patent: Jun. 25, 1996

[54] APPARATUS FOR THE PRODUCTION OF PATTERNED TUFTED FABRIC

[76] Inventor: Helmut Piller, Clara-Hätzler-Str. 5, D-86161 Augsburg, Germany

[21] Appl. No.: 436,104

[22] Filed: May 8, 1995

[30] Foreign Application Priority Data

May 24, 1994 [DE] Germany ..... 44 18 084.5

[51] Int. Cl.[6] ..... D05C 15/20; D05C 15/34

[52] U.S. Cl. ..... 112/80.43

[58] Field of Search ..... 112/80.01, 80.43, 112/80.44, 80.45

[56] References Cited

U.S. PATENT DOCUMENTS 4,064,816 12/1977 Spanel et al. ..... 112/80.43
4,224,309 1/1981 Spanel et al. ..... 112/80.43 X

FOREIGN PATENT DOCUMENTS 3722006 1/1989 Germany ..... 112/80.43

*Primary Examiner*—Paul C. Lewis
*Attorney, Agent, or Firm*—Edwin D. Schindler

[57] ABSTRACT

In the context of an apparatus for the manufacture of patterned tufted fabric comprising a needle bar, which has a transverse member extending right along its length, on which a plurality of rotatably mounted needle carriers are arranged in a row, which respectively bear several radially projecting needles for threads and by means of a swiveling device are able to be moved into stitching positions, it is possible to attain a high degree of accuracy and a compact construction if the swiveling device associated with each needle carrier, which is able to be locked by means of an abutment device in the stitching positions of its needles, possesses an associated transmission element able to be actuated by an associated drive device and in mesh with a segment provided on the needle carrier side, or if the needle carriers are designed a rotors of disk rotor stepper motors arranged in a row on the transverse member, respectively having a disk-like stator which is stationary in relation to the transverse member and at least one rotor adjacent to the same and preferably flanking two thereof.

11 Claims, 6 Drawing Sheets

APPARATUS FOR THE PRODUCTION OF PATTERNED TUFTED FABRIC

BACKGROUND OF THE INVENTION

The invention relates to an apparatus for the production of patterned tufted fabric comprising at least one needle bar extending athwart the feed direction of a fabric web and adapted to perform stitching movements perpendicularly to the plane of the web, such needle bar containing a transverse member extending right along its length and on which a plurality of needle carriers are rotatably mounted in a row, each carrier bearing radially projecting needles adapted to guide an associated thread and by means of an associated swiveling device are able to be moved into stitching positions respectively associated with their needles.

THE PRIOR ART

An arrangement of this type is disclosed in the German patent publication 3,722,006 A1. This known arrangement has not proved to be sufficiently compact and accurate so that only comparatively few pile threads may be provided per unit area.

SHORT SUMMARY OF THE INVENTION

Taking this prior art as a starting point one object of the invention is to so improve an apparatus of the type initially mentioned here with simple and low-price means that it is possible to ensure a high degree of accuracy and compactness.

In accordance with a first design adapted to achieve this aim the swivel device associated with each needle carrier possesses a transmission element adapted to be actuated by means of an associated drive device, and in mesh with a segment provided on the needle carrier side and furthermore each needle carrier is able to be locked in the stitching position of its needles by means of an abutment device.

These features ensure that the needle carriers, despite their meshing drive, are locked in each stitching position with a high degree of precision, something which even at high rates of swiveling of the needle carriers ensures a gentle and trouble-free manner of operation. The use of mutually meshing and preferably toothedly engaging transmission elements for driving the needle carriers furthermore ensures a sturdy construction, something which leads to high operational reliability and trouble-free working. Nevertheless the said features are responsible for a design of the needle carriers which is more slender than in the known arrangement and therefore leads to the production of a more dense pile.

In accordance with a second design for attaining the above mentioned purpose of the invention the needle carriers are designed in the form of rotors of disk rotor arrangements, which are arranged in sequence on the transverse member, respectively have a disk-like stator which is stationary in relation to the transverse member and at least one rotatably mounted disk-like rotor adjacent to same and are designed in the form of a disk rotor motor, whose stators for each associated rotor respectively having dot-like permanent magnet zones, comprise a number, corresponding to the number of needles of such rotor, of dot-like electromagnet zones able to be controlled by means of a control device and having an angular spacing equal to the angular spacing of the needles and which as regards their axial spacing and their configuration are matched to the permanent magnet zone of the associated rotor.

The disk stator arrangements in accordance with the invention practically constitute disk rotor stepper motors, which owing to the disk-like configuration of the stator and the rotor, render possible a particularly slender design so that along the length of the bar a comparatively large number of disk rotor arrangements, and therefore needle carriers, may be placed, something which renders possible the production of particularly dense piles. Since only the electromagnet parts of the stator must be supplied with current, wiring is simple without wearing parts, something which leads to freedom from the need for servicing. Simultaneous control of the electromagnet parts may be simply controlled by switching the power supply on and off. Furthermore in this case abutment elements can be dispensed with.

In accordance with an advantageous further development of the above mentioned features it is possible for each stator to be flanked by two rotors, which respectively possess diametrally opposite permanent magnet zones. This feature leads to the advantage of there being two needle carriers for each disk rotor arrangement so that a particularly small lateral needle clearance is possible, this leading to particularly high pile densities.

Further advantageous developments and convenient features of the invention will be gathered from the claims and the following description of embodiments of the invention in conjunction with the accompanying drawings.

LIST OF THE SEVERAL VIEWS OF THE FIGURES

DETAILED ACCOUNT OF WORKING EMBODIMENTS OF THE INVENTION

The basic design and the manner of operation of tufting machines are generally well known and therefore are not in need of any detailed description for the present purpose.

Figure 1:
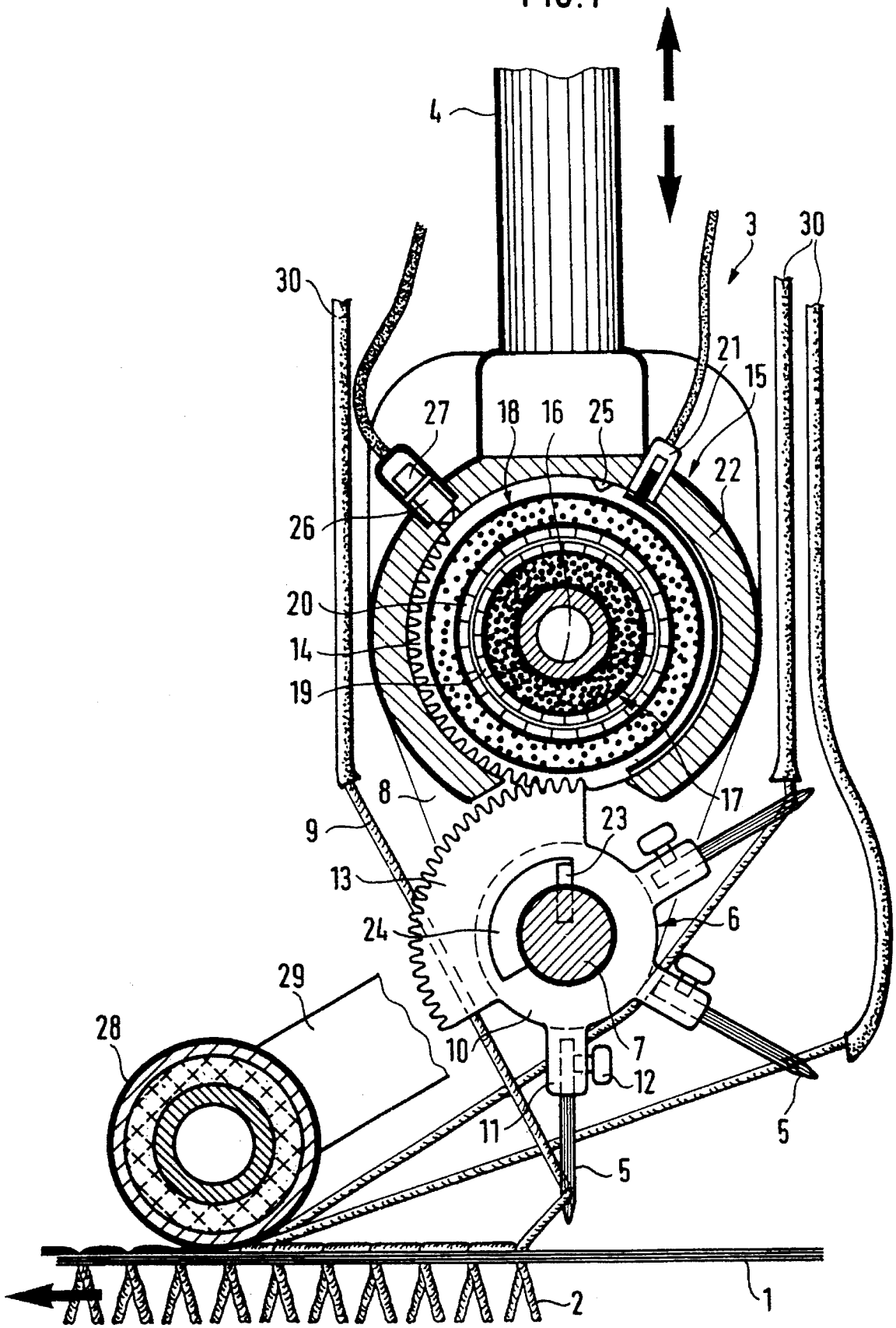
FIG. 1 shows a cross section taken through a needle bar in accordance with the invention with external rotor electric motors associated with the needle carriers.
Figure 2:
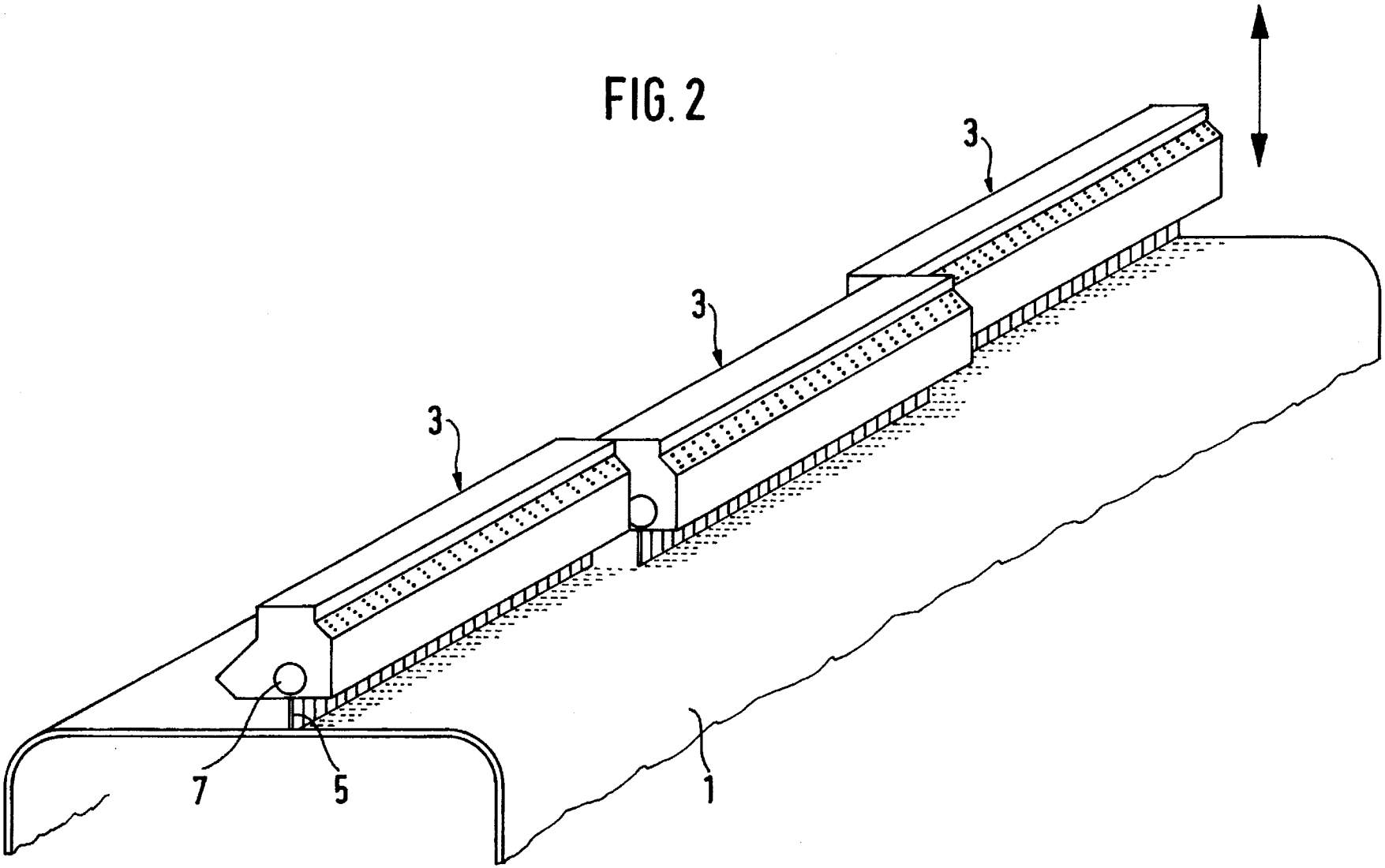
FIG. 2 is a perspective external view of a plurality of needle bars arranged in sequence.

The tufting machine illustrated in FIGS. 1 and 2 comprises a plurality of needle bars 3, which are arranged behind each other in sequence over the width of the fabric which is tufted, that is to say into which pile threads 2 are sewn or stitched, such bars being adapted to be moved upward and downward by means of a drive device, in this case indicated by a thrust rod 4, for performing stitching movements of their respectively downwardly directed needles 5 perpendicularly to the plane of the fabric web 1, as is indicated by a double arrow. The division of the needle bars over the width of the fabric web 1 means that individual arrangement may easily be produced.

The needle bars 3 each comprise a series of needle carriers 6 arranged one behind the other in sequence across the width of the fabric web. Such needle carriers are mounted on a transverse member 7, in this case designed in the form of a round rod. At its ends the transverse member 7 is attached to the lateral bearing mounts 8 of the associated needle bar 3 and accordingly constitutes a stationary shaft, on which the needle carriers 6 are mounted in a row. They each bear several needles 5, which are offset by the same angle and project radially in relation to the transverse member 7 and of which one respective one is in the downwardly directed working setting. Through each needle an associated thread 9 is threaded, same being drawn off from a creel, not illustrated here in detail. In this respect it may be a question of different threads so that by changing the respective needle 5 coming into operation a pattern may be produced.

For this purpose the needle carriers 6 are mounted on the transverse member 7 in a rotatable fashion in relation to its axis. The needle carriers 6 accordingly possess a hub 10 through which the rod, constituting the transverse member 7, extends, such hub 10 being provided with radially projecting holding collars 11 for carrying one needle 5 each. In the illustrated working embodiment of the invention there are accordingly three holding collars 11 respectively offset by 60° in relation to one another. The needles 5 are able to be fixed in the respectively associated holding collar 11 in a twist preventing manner, as is indicated by a set screw 12.

In order to move the respectively desired needle 5 into the working position thereof, each hub 10 has an associated swiveling device. For this purpose each hub 10 is provided with a toothed segment 13 in the peripheral part opposite to its holding collars 11, such segment 13 being in mesh with an associated transmission element, in the present case also in the form of toothed segment 14 of a drive device. Such drive device is in the illustrated working embodiment designed in the form of an external rotor motor 15. Along the length of the needle bar 3 a number of external rotor motors 15 is provided which corresponds to the number of needle carriers 6 arranged in a row. There is accordingly a motor sequence or row, associated with the row of needle carriers, of adjacently placed external rotor motors 15, which in the longitudinal direction of the needle bar are made just as slender as the associated needle carriers 6. For mounting the row of motors the needle bar is provided with a second transverse member 16 parallel to the transverse member 7 associated with the needle carriers 6. On such parallel transverse member 16 per motor there is one fixed, internal stator 17 and a rotatable rotor 18 fitted around same. On the periphery of the external rotor 18 it is respectively possible for the toothed segment 14, which is in mesh with the toothed segment 13 on the needle carrier side, to be mounted or, respectively, molded. The stator 17 is provided with a ring of permanent magnets 19 arranged at its external periphery. The rotor 18 is provided with a ring of electromagnets 20 encircling the ring of permanent magnets. Such electromagnets 20 are able to be supplied with power by a slip ring contact arrangement 21 in such a manner that a rotary movement of the desired type is produced. The slip ring contacts of the adjacently placed external rotor motors 15 may be arranged in a housing casing 22 arranged coaxially to the transverse member 16, which housing casing on the needle carrier side possesses an engagement opening for the toothed segments 13 of the adjacently placed needle carriers 6. The transverse member 16 and the housing casing 12 may like the transverse member 7 be attached to the lateral bearing mounts 8.

The slip ring contacts 21 of the adjacently placed external rotor motors 15 are so supplied by means of a control device, not depicted here in detail, in a fashion dependent on the pattern to be tufted that the needle 5 bearing the respectively desired thread 9 is moved into the downwardly directed working position and such thread 9 is moved through the fabric web 1 on the next stroke of the needle bar 3. In order to ensure a high accuracy of positioning of the needle 5 located in the working position each needle carrier 6 is able to be locked in the working position of its needles 5 by means of an abutment device.

In the illustrated working embodiment of the invention the abutment device comprises a terminal abutment device with two abutment positions associated with the two outer needles 5 and a detent device with a detent position associated with one of the central needles 5. For the formation of the terminal abutment device the transverse member 7 is, for each needle carrier 6, provided with a radially projecting pin 23, which fits into an interrupted peripheral groove 24 in the hub 10 of the associated needle carrier 6. In the abutment positions the pin 23 strikes mutually opposite ends of the groove 24. The groove 24 extends in the illustrated working embodiment for an angular distance of 120° corresponding to the angular distance between the two associated external needles 5. For the formation of the detent device the rotor 18 of each external rotor motor 15 is provided with a peripheral notch 25, into which a respectively associated detent pin 26 may slip with a detent action, such pin 26 being arranged on the housing casing 22. The pin 26 may be operated by means of a respectively associated reciprocating magnet 27, which by means of the above mentioned control device is also operated in a manner dependent the desired pattern.

Ahead of each needle bar 3 a roller 28 is arranged adapted to roll on the fabric web 1, such roll 28 being able to be mounted on lugs 29 pivotally mounted on the bearing mounts 8. The roller 28, whose weight bears on the fabric web 1, functions as a holding down means for the thread run, which may in some cases be long, festooned between the respectively last stitch and the associated needle 5. In many cases it can be convenient for the stitched in pile threads 2 to be fixed in place by means of adhesive applied and respectively melted by the roller 28. In the case of the use of a hotmelt adhesive already present on the back of the fabric web 1 it is possible for the roller 28 to be provided with heating means for fusing such hotmelt adhesive.

For guiding the threads 9 from the creel to the needles 5 it is possible to provide hose 30, such pieces of hose terminating in this case adjacent to the needles 5.

Figure 3:
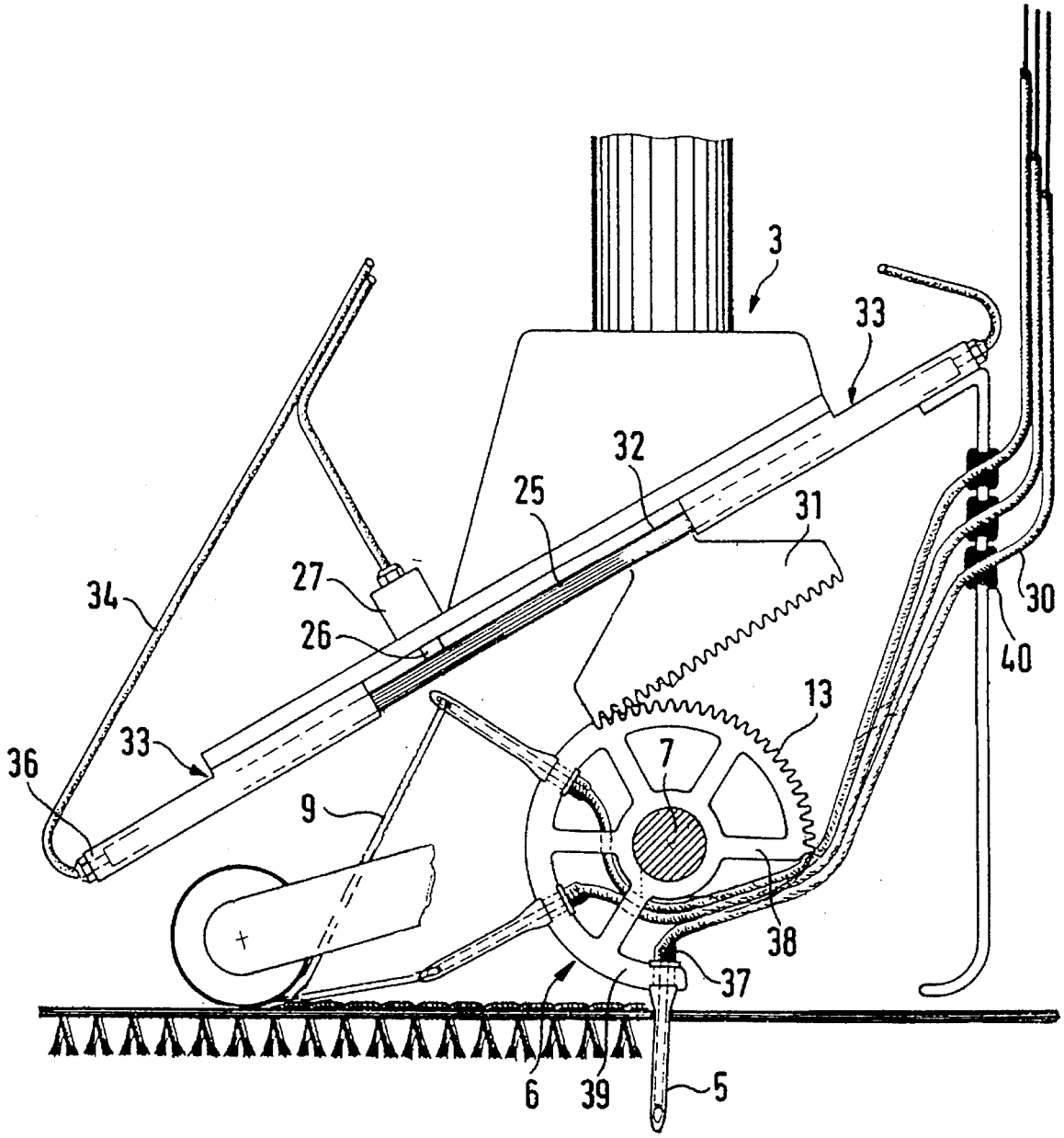
FIG. 3 is a cross section taken through a needle bar in accordance with the invention with pneumatic linear motors associated with the needle carriers.
Figure 4:
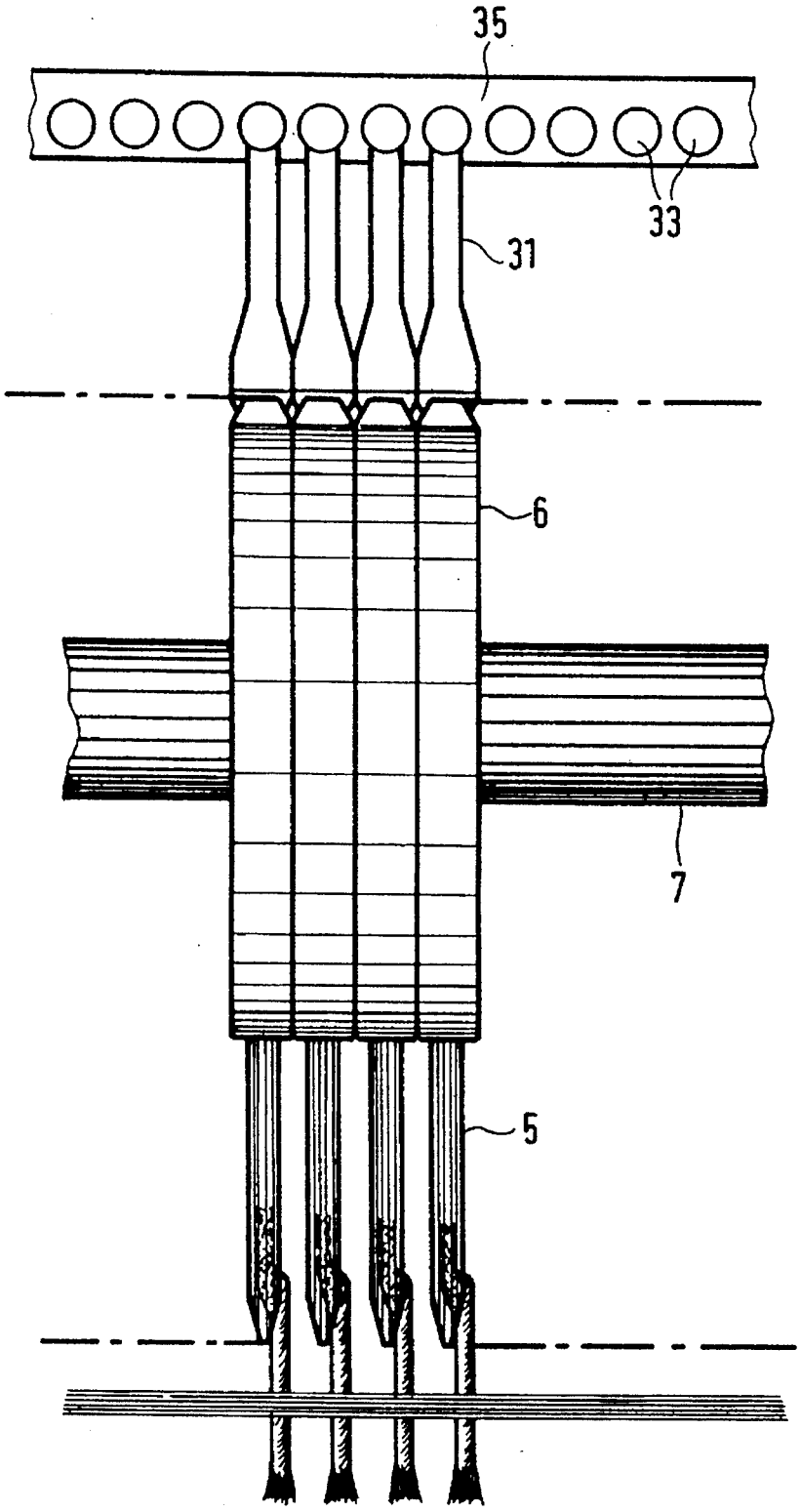
FIG. 4 is a diagrammatic rear view of part of the arrangement in accordance with FIG. 3.
Figure 5:
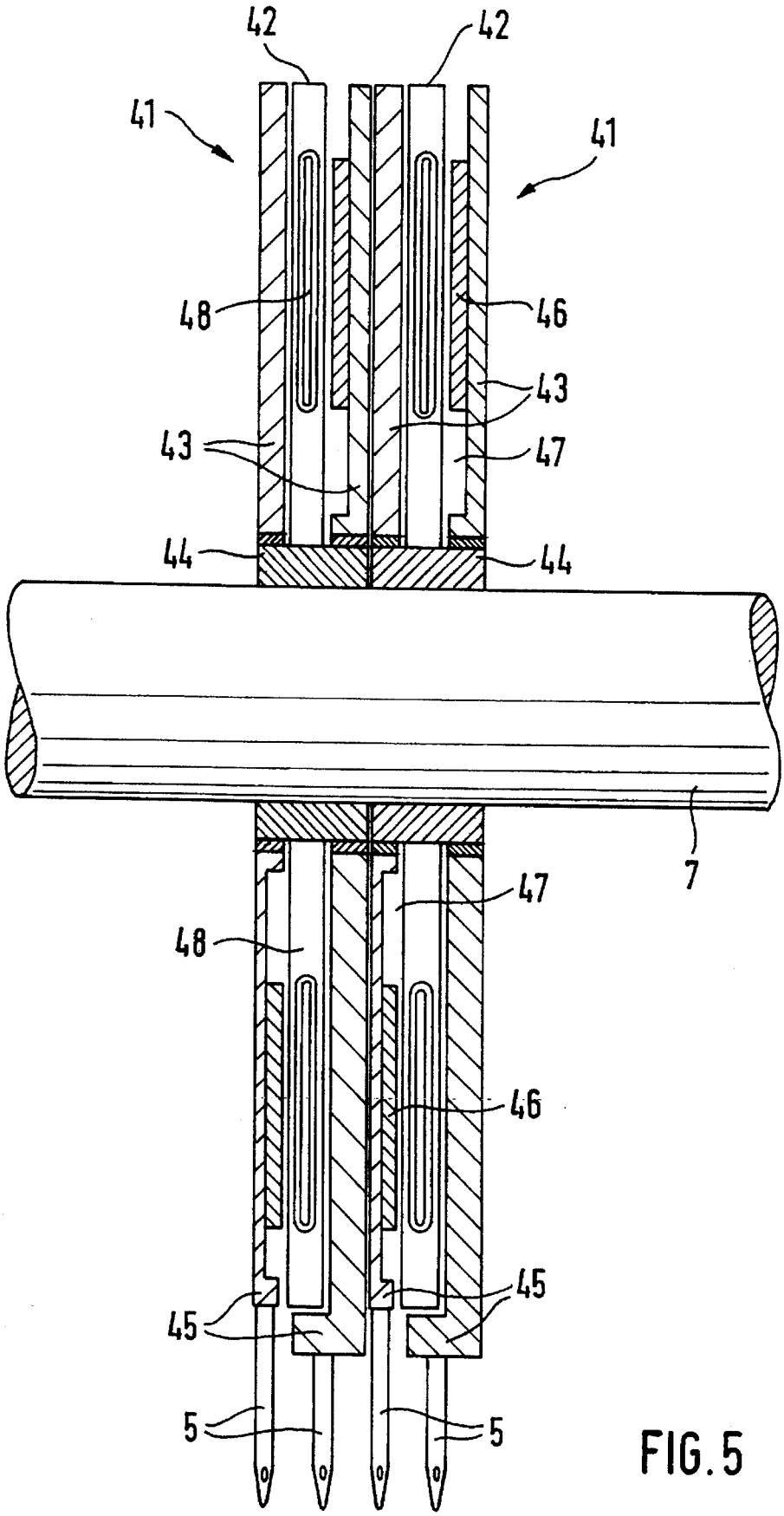
FIG. 5 is a cross section taken through a needle bar in accordance with the invention having needle carriers integrated in disk rotor stepper motors.
Figure 6:
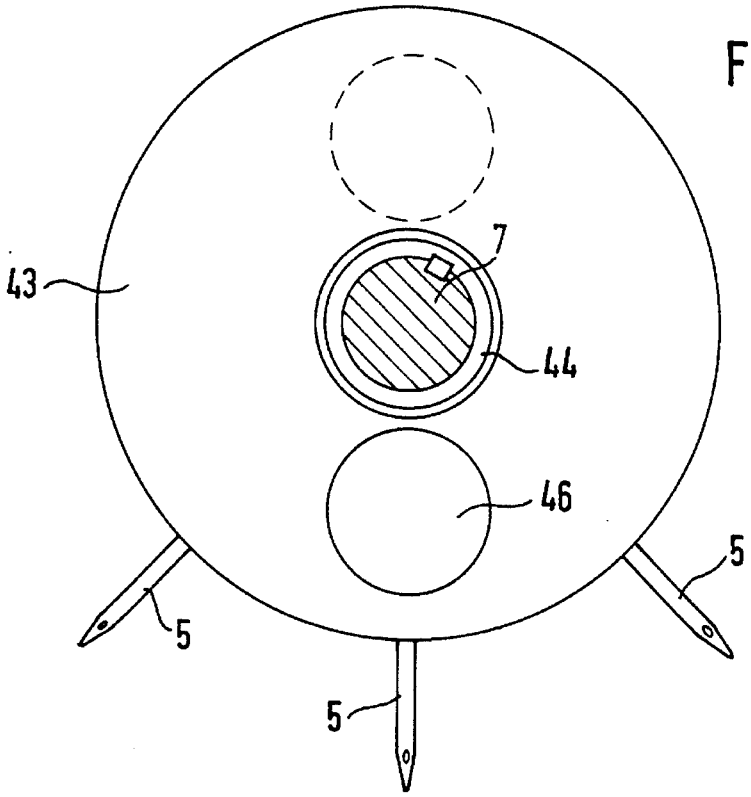
FIG. 6 is diagrammatic elevation of a stator of the arrangement in accordance with FIG. 5.
Figure 7:
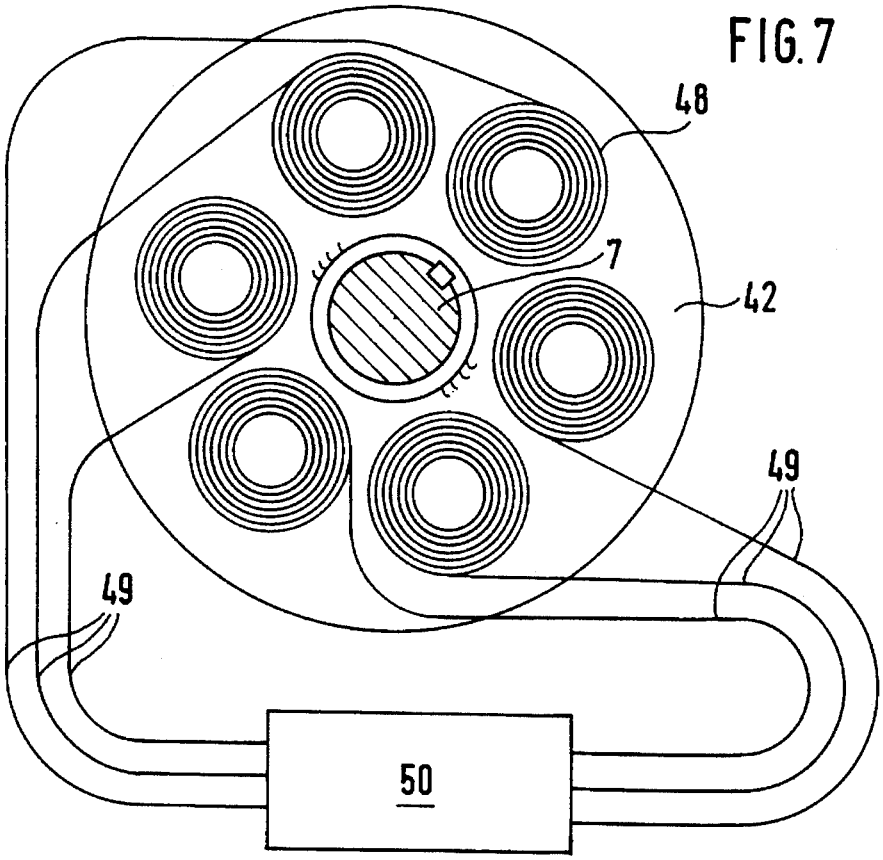
FIG. 7 is a diagrammatic elevation of one rotor of the arrangement FIG. 5.

The basic design and the basic manner of working of the arrangement in accordance with FIGS. 3 and 4 and, respectively, FIGS. 5 through 7 are the same as that of the arrangement in accordance with FIGS. 1 and 2. In what follows the description will be primarily directed the differences between such designs, like parts being denoted by like reference numerals.

In the design in accordance with FIGS. 3 and 4 the needle carriers 6 are able to be swiveled by means of a pneumatic linear drive. Accordingly the toothed segment 13 of each needle carrier 6 is in mesh with an associated rack 31, which is able to be reciprocated by means of an associated, pneumatic drive device. For this purpose in the illustrated working embodiment there is a piston rod 32 bearing the respectively associated rack 31, such piston rod 32 being terminally provided with pistons in associated cylinders. The oppositely placed piston and cylinder units 33 so formed having a common piston rod 32 are designed to be single acting and are oppositely supplied with compressed air and are vented to produce an opposite action.

The piston and cylinder units 33 may be supplied the fluid under pressure as a source of energy via respective separate lengths of hose 34. However it would be feasible also for the mutually opposite row of piston and cylinder units 33, which are opposite to one another and extend along the length of the associated needle bar 3, to be provided with a common supply rail 35 extending along the full length of the bar, as best shown in FIG. 4. These supply rails 35 possess connections for each associated piston and cylinder units 33. The piston and cylinder units 33 are in each case provided with an inner switch valve 36. The switch valves 36 are operated by means of a control device (not illustrated) in a manner dependent the desired pattern.

The piston and cylinder units 33 in this case function respectively as a linear drive and simultaneously as a terminal abutment device, since in terminal positions thereof the pistons strike an associated abutment. Accordingly only one detent device is required for ensuring exact positioning in the center working position. For this purpose the piston rod 32 may be provided with a notch 25, into which a preferably magnetically actuated detent pin 26 may snap, whose actuating magnet 27 is operated in accordance with the pattern to be produced.

The needles 5 mounted on the needle carriers 6 may, as in the arrangement depicted in FIGS. 1 and 2, be provided with eyes for threading the respectively associated thread 9. In the illustrated working embodiment of the invention the needles 5 are in the form of hollow needles. Accordingly there is a channel extending through the needles and through such channel the respectively thread 9 may be threaded through. The hose 30 provided for guidance of the threads 9 may here pass through as far as the respectively associated needle 5. The needles 5 are in the illustrated working embodiment provided at rear ends thereof with a nipple 37 over which the respectively associated hose 30 can be slipped so that there is a thread guiding channel extending as far as the front end of the needle. This facilitates threading of the threads. The respective thread may here simply be drawn into the associated guiding channel with the aid of compressed air. The needle carriers 6 are in the present case designed in the form of spoked wheels with a hub 11 mounted in a rotating manner on the transverse member 7, and a wheel rim 39 held on the spokes 38. This facilitates mounting of the needles 5 and the associated nipples 37, over which the hose 30 is slipped. Such nipples are held on a holder 40 on the bar side. In the part between the holder 40 and the respectively associated nipple 37 the hose 30 may be conveniently designed with bellows folds so that undesired strain may be prevented.

The adjacently placed needle carriers 5, as furthermore illustrated in FIG. 4, fit together at their ends. In order to prevent wear the end surfaces may be provided with anti-friction means, as for instance with Teflon coatings. The same may apply for the racks 31.

In the case of arrangement of FIGS. 5 through 7 the needle carriers are respectively integrated in disk rotor arrangements 41 assembled together like a disk rotor motor and placed in sequence on the transverse member 7. The disk rotor arrangements 41 each comprise, as best illustrated in FIG. 5, a disk-like stator 42, which is stationary in relation to the transverse member 7 and two rotatably mounted disk-like rotors 43 flanking the associated stator 42. The stator 42 and the associated rotors 43 are respectively mounted on a common bearing ring 44 so that subassemblies readily able to be pre-assembled are produced. The bearing rings 44 are fixed on the transverse member 7 without being able to rotate, for instance by being screwed and/or keyed to the transverse member 7. The stator 42 is secured to the bearing ring 44 or, respectively, molded thereon. The rotors 43 are rotatably mounted on the bearing ring 44. For this purpose a plain or anti-friction bearing may be provided.

The rotors 43 of non-magnetic or, respectively, magnetic material such as aluminum sheet etc. in this case function as needle carriers, which on their periphery bear a plurality of, in the illustrated embodiment also three, radially projecting needles 5 offset by equal angles, of which respectively one will be located in the downwardly directed working setting. The lateral distance between the needles 5 is the same along the entire length of the bar. In order to ensure this it is possible for the rotors 43 to be provided in the segment associated with their needles 5 with facing cranked parts 45 carrying the needles 5, such cranked parts being the same or different. A thread may be threaded through each needle 5. The needles 5 are in the illustrated embodiment for this purpose provided at their front ends with an eye.

The rotors 43 are respectively provided with a button-like permanent magnet 46, which is set in an associated recess 47 open to the rotor side in the disk constituting the respective rotor 43. The button-like permanent magnets 46 constitute a dot-like permanent magnet arrangement, that is to say one not encircling the axis, on the respectively associated rotor 43. The permanent magnets 46 of the two rotors 43 associated with a stator 42 are, as shown in FIG. 5, offset from one another by 180°. In the illustrated working embodiment of the invention the permanent magnet 46 of the left rotor is located in the lower rotor half as is indicated in FIG. 6 in continuous lines and the magnet of the right rotor is in the upper rotor half as indicated in FIG. 6 with interrupted lines.

In the disk respectively constituting one stator 42 and preferably consisting of synthetic resin, the stator windings 48, associated with the two flanking rotors 43, are let into or molded into the material. The stator windings 48 are, as shown in FIG. 7, able to be supplied via associated lines 49 with current and function, when supplied with power, as electromagnets, by which the respectively facing permanent magnet 46 of the rotor is able to be attracted so that the respective rotor 43 may be caused to perform one step of a rotary movement. For each of the two associated rotors 43 the stators 42 possess a number of windings 48 equal to the number of needles 5 of each rotor 43. In the illustrated working embodiment of the invention there are accordingly three windings 48 per rotor 43. All in all there are therefore on each stator 42 six windings 48 which in accordance with the arrangement of the permanent magnets 46 of the rotor side are so arranged that one half of the windings is in the upper rotor half and the other half thereof is in the lower rotor half.

Since the permanent magnets 46 of the rotors 43 placed back to back, of adjacent disk rotor arrangements 41, as well shown in FIG. 5, are offset by 180° from one another there is in the form of the rotor half respectively not having a permanent magnet a screening effect for the associated stator 42 from the permanent magnet 46 of the respectively adjacent rotor 43. Thus for example the lower rotor half of the right rotor 43 of the one disk rotor arrangement 41 will screen off the lower half of the associated stator 42 and, respectively, the windings 48 arranged thereon from the permanent magnet 46 of the left rotor 43 of the respectively adjacent disk rotor arrangement 41. In the upper halves there will be just the opposite conditions. Accordingly it is possible to ensure that there is no mutual interference.

The windings 48 are, as well shown in FIG. 7, arranged on a pitch circle centered on the axis of the transverse member 7. The axial distance between the centers of the windings 48 is approximately equal to the axial distance of the centers of the permanent magnets 46 on the rotor side. The configuration of the windings 48 is adapted to the button-like configuration of the permanent magnets 46. The angular clearance between the respectively associated three upper and, respectively, three lower windings 48 is the same as the angular distance of the needles 5 of the associated rotor 43. Each needle 5 is therefore provided with a winding 48. When the permanent magnet 46 of a rotor 43 is in alignment with one of the associated windings 48 on the stator side, the needle 5 respectively associated with such winding 48 will be in the working position. In this case abutments are unnecessary, but might readily be provided in a manner similar to that indicated in FIG. 1.

The windings 48 are, as already mentioned, able to be supplied with electrical power by means of the lines 49 indicated in FIG. 7. Such supply of power is performed in such a manner that respectively only one winding 48 of the three windings 48 associated with a rotor 43 is supplied with power and the other two are not supplied. The winding 48 supplied with power will attract the permanent magnet 46 of the associated rotor 43 so that the needle 5 associated with the permanent magnets 48 will assume its working position. For the control of the power supply for the permanent magnets 48 a control device 50 is provided. The same may be designed in the form of a programmed control device, which for each stroke of the needle bar converts stored data into respective switching signals for all windings 48 of this needle bar.

The adjacent disk rotor arrangements 41 are arranged one after the other practically without any clearance so that the rotors 43 facing one another of adjacent disk rotor arrangements 41 have their facing surfaces in contact with each other. By the same token it is possible for the rotors 43 of each disk rotor arrangement 41 to be in contact with the respectively associated stator 42. In order to avoid wear the surfaces in contact with each other are adapted to slide on each other. For this purpose a Teflon coating on the side flanks of the stators 42 and/or rotors 43 may be provided.

I claim:

1. An apparatus for production of a patterned tufted fabric, comprising:

at least one needle bar extending athwart a feed direction of a fabric web and adapted for performing stitching movements perpendicularly to a plane of the fabric web;

a drive device;

a plurality of needle carriers;

a transverse member being included as a part of said needle bar, said transverse member extending along the length of said needle bar, said plurality of needle carriers being rotatably mounted in a row on said transverse member, a swiveling device having a transmission element adapted to be actuated by means of said drive device, said transmission element being in the form of a first segment mounted on a rotor of an external rotor motor, said external rotor motor having a stator provided on a transverse member carrier parallel to said transverse member and being provided with permanent magnets with said external rotor encircling said stator, said external rotor being provided with at least one electromagnet powerable via a slip ring contact; and, an abutment device with each of said needle carriers of said plurality of needle carriers bearing radially projecting needles adapted for guiding an associated thread and by means of said swiveling device are moved into stitching positions respectively associated with their needles, said swiveling device associated with each of said needle carriers being in mesh with a second segment provided on a needle carrier side with each of said needle carriers being lockable in the stitching position of its needles by means of said abutment device.

2. The apparatus for the production of a patterned tufted fabric according to claim 1, wherein said abutment device possesses a terminal abutment device with two oppositely placed abutment positions and a detent device with at least one detent pin to be actuated by means of an electrical actuating device, said detent pin is able to slip into a central notch.

3. An apparatus for production of a patterned tufted fabric, comprising:

at least one needle bar extending athwart a feed direction of a fabric web and adapted for performing stitching movements perpendicularly to a plane of the fabric web;

a linear drive device;

a plurality of needle carriers;

a transverse member being included as a part of said needle bar, said transverse member extending along the length of said needle bar, said plurality of needle carriers being rotatably mounted in a row on said transverse member, a swiveling device having a transmission element adapted to be actuated by means of said linear drive device, wherein said transmission element is a rack connected with said linear drive device; and, an abutment device with each of said needle carriers of said plurality of needle carriers bearing radially projecting needles adapted for guiding an associated thread and by means of said swiveling device are moved into stitching positions respectively associated with their needles, said swiveling device associated with each of said needle carriers being in mesh with a segment provided on a needle carrier side with each of said needle carriers being lockable in the stitching position of its needles by means of said abutment device.

4. The apparatus for the production of a patterned tufted fabric according to claim 3, wherein for each of said racks, said linear drive device contains two oppositely placed single acting piston and cylinder units.

5. The apparatus for the production of a patterned tufted fabric according to claim 4, wherein said single acting piston and cylinder units are mutually adjacent one another and wherein said mutually adjacent piston and cylinder units of adjacent needle carriers are adapted to be connected via associated valves with a fluid power distributing chamber extending along the length of said needle bar.

6. The apparatus for the production of a patterned tufted fabric according to claim 3, wherein said abutment device possesses a terminal abutment device with two oppositely placed abutment positions and a detent device with at least one detent pin to be actuated by means of an electrical actuating device, said detent pin is able to slip into a central notch.

7. An apparatus for production of a patterned tufted fabric, comprising:

at least one needle bar extending athwart a feed direction of a fabric web and adapted for performing stitching movements perpendicularly to a plane of the fabric web;

a plurality of needle carriers;

at least one swiveling device; and, a traverse member being included as part of said needle bar, said transverse member extending along the length of said needle bar, said plurality of needle carriers being mounted on said transverse member, each of said needle carriers bearing radially projecting needles adapted for guiding an associated thread and by means of an associated said swiveling device are movable into stitching positions respectively associated with their needles, wherein said needle carriers are in the form of rotors of disk rotor arrangements, which are arranged in a sequence on said transverse member, respectively having a disk-like stator being stationary in relation to said transverse member and at least one rotatably mounted disk-like rotor adjacent thereto in the form of a disk rotor motor, said stators for each associated rotor respectively having dot-like permanent magnet zones, comprises a number, corresponding to the number of needles of said rotors, of dot-like electromagnet zone controlled by means of a control device and having an angular spacing equal to an angular spacing of the needles and, as regards their axial spacing and their configuration, are matched to a permanent magnet zone of the associated rotor.

8. The apparatus for the production of a patterned tufted fabric according to claim 7, wherein each of said stators is flanked by two rotors constructed as needle carriers which, respectively, possess diametrically opposite permanent magnet parts.

9. The apparatus for the production of a patterned tufted fabric according to claim 7, further comprising guide respective hose means for guiding the associated thread.

10. The apparatus for the production of a patterned tufted fabric according to claim 7, wherein said needles are hollow needles.

11. The apparatus for the production of a patterned tufted fabric according to claim 10, further comprising guide respective hose means for guiding the associated thread, said hose means being connected with a rear needle end.

* * * * *